US006485374B1

(12) United States Patent
Myerscough

(10) Patent No.: US 6,485,374 B1
(45) Date of Patent: Nov. 26, 2002

(54) GOLF BALL STRIKING TRAINER

(76) Inventor: Julian Myerscough, Fohrenweg 6, Rotkreuz CH 6343 (CH)

( * ) Notice: Subject to any disclaimer, the term of this patent is extended or adjusted under 35 U.S.C. 154(b) by 31 days.

(21) Appl. No.: 09/602,101

(22) Filed: Jun. 22, 2000

(30) Foreign Application Priority Data

Jun. 29, 1999 (GB) ..... 99-14994.0
Feb. 7, 2000 (GB) ..... 0002694.8

(51) Int. Cl.[7] ..... A63B 69/36

(52) U.S. Cl. ..... 473/222; 473/151; 473/219; 473/221; 473/225; 473/278

(58) Field of Search ..... 473/150, 151, 473/219, 221, 222, 223, 225, 226, 229, 231, 257, 258, 278

(56) References Cited

U.S. PATENT DOCUMENTS 4,306,722 A * 12/1981 Rusnak ..... 473/221
4,306,723 A * 12/1981 Rusnak ..... 273/DIG. 26
4,342,455 A * 8/1982 Miyamae ..... 473/222
4,844,469 A * 7/1989 Yasuda et al. ..... 473/221
5,718,639 A * 2/1998 Bouton ..... 473/151
5,826,874 A * 10/1998 Teitell et al. ..... 473/225
6,227,984 B1 * 5/2001 Blankenship ..... 473/221

FOREIGN PATENT DOCUMENTS

GB 2096469 * 10/1982 ..... 273/186.2

* cited by examiner

*Primary Examiner*—Raleigh W. Chiu
(74) *Attorney, Agent, or Firm*—Michael Best & Friedrich LLP

(57) ABSTRACT

A golf swing trainer 10 comprises a golf club 12 and a mat 14. A head 13 of the golf club 12 has an electrically conducting leading edge 16 and an electrically non-conducting/insulating sole 18. When the golf club 12 is swung correctly, at the bottom of the player's swing the leading edge 16 makes an electrical contact between contacts 20*a* and 20*b*, which are embedded in the mat 14. The electrical contact between the leading edge 16 and the contacts 20*a* and 20*b* completes an electrical circuit and causes an alarm (not shown) to indicate by a sound or light for instance that correct contact has been made and a good swing has been performed.

18 Claims, 3 Drawing Sheets

GOLF BALL STRIKING TRAINER

This invention relates to a golf swing training device and to a method of training a player's golf swing.

A previous device for training the swing of a person playing golf determines the speed, direction and orientation of the club face in the area in which the club face contacts a golf ball.

Problems arise with the above mentioned device because it is not able to indicate the height of the club head as it passes through the ball striking area. The height of the club head is clearly important because it gives the position of the club head relative to the ball being struck. Incorrect location could result in a ball being struck incorrectly.

It is an object of the present invention to address the above mentioned disadvantages.

It is a further object of the present invention to provide a golf swing trainer which has a club head height indication means for the club head as it passes through the ball striking area.

It is also an object of the present invention to provide a method of training a person's golf swing to more accurately control the height of the club head as it passes through the ball striking area.

According to one aspect of the present invention a golf swing trainer comprises a golf club portion and a mat portion, the golf club portion comprising a shaft section and a head section, which head section has a section which is electrically conducting, the mat portion providing a surface on which to practise a golf swing and including at least one electrical contact, wherein indicator means of the trainer are operable to be activated when contact is made between the electrically conducting section of the head section and the or each electrical contact.

Preferably the electrically conducting section is a section of a sole portion of the head section. Preferably, the sole portion additionally includes an electrically non-conducting section. The electrically non-conducting section is preferably larger than the electrically conducting section.

The electrically conducting section of the sole portion may be elongate. The electrically conducting section may be located along a front edge of the sole portion. The electrically conducting section may be located along a leading edge of the head section of the golf club portion, which leading edge is the foremost part of the head section. The electrically conducting section may extend substantially along the length of the head section.

The electrically conducting section may be flush with the non-conducting section, to provide a smooth outer surface of the sole portion. The electrically conducting section may be flush with a front face of the head section, to provide a smooth striking face for striking a ball.

The electrically non-conducting section may be located to the rear of the electrically conducting section. The electrically non-conducting section may have a flat shape or may have a curved, preferably outwardly curved, shape.

The shaft section of the golf club portion may be inclined in a forward direction when the sole portion is generally parallel to an upper surface of the mat portion. The inclination of the shaft may encourage an intended downward swing in a user of the golf swing trainer.

The rear section of the sole portion may be lower than a front section of the sole portion, when the shaft of the club portion is in a generally vertical orientation. The angle made between a line extending forward from the sole portion and parallel thereto and an axis of the shaft is preferably less than 90°.

The or each electrical contact may project preferably by a small amount, above an upper surface of the mat, to allow contact to be made between the conducting section and the or each electrical contact.

The or each contact may be received in a recess in the mat. The or each electrical contact may be elongate. The long axis of the or each electrical contact may be aligned generally in the direction of swing of the golf club portion. The length of the or each contact may be chosen to suit a particular level of difficulty associated with use of the trainer; a longer contact may be chosen for an easier level, with a shorter contact for greater difficulty.

Preferably, at least one pair of electrical contacts is provided, in which the electrically conducting portion of the golf club is arranged to complete an electrical circuit by bridging said at least one pair of electrical contacts.

Where two electrical contacts are provided, the contacts may form two ends of an open circuit that includes the indicator means and a power supply. The open circuit may be closable by means of the electrically conducting portion of the golf club contacting both contacts, thereby causing the indicator means to be activated. Where two electrical contacts are provided, they may be arranged in a 'V'-shaped configuration, preferably converging generally in the direction of swing of the golf club portion.

The electrical contacts may comprise at least two lengths of a plurality of electrical contacts, the contacts in each length preferably being connected together in series. Said lengths of electrical contacts may be arranged for interleaving location adjacent to one another. An electrical connection made between two contacts of the two lengths of electrical contacts may result in completion of the electrical circuit. Contact between any one of the electrical contacts on one length with any one of the electrical contacts on another length may be sufficient to complete the circuit. The electrical contacts from both lengths may be arranged linearly. A plurality of pairs of lengths of electrical contacts may be provided, with electrical contact between any two electrical contacts of a pair of lengths being sufficient to complete the electrical circuit.

Each electrical contact may be connected separately to a control means of the golf swing trainer.

The electrical contacts may extend through the mat portion in tubular contact receiving sections, in which case the electrical contacts may be elongate wires. In such a case, the electrical contacts may protrude slightly above the tubular contact receiving sections. A plurality of tubular contact receiving sections may be provided to allow electrical contact to be made between one group of electrical contacts and another group of electrical contacts to complete the electrical circuit. The electrical contacts in each group may be arranged in a brush configuration. Each group of electrical contacts may be separated by an insulating portion of the mat. The groups of contacts may be arranged in linear patterns.

The mat may include an upwardly projecting contact guard. The guard may be located behind the or each contact. The guard may project upwards to prevent a sweeping, horizontal, swing of the golf club portion from making contact with the electrical contacts. The guard may encourage a more vertical angle of approach to the electrical contacts than would otherwise have been possible with the golf club portion in the absence of the contact guard.

The guard may be wedge shaped, preferably tapering towards the contacts. The contact may be removable. Different sizes of guard may be provided. The guard may be made of compressible material.

The trainer may include a tether portion arranged to limit the length of back swing of a person using the trainer. The tether may be secured at one end of the golf club portion, preferably close to the head section thereof, and at another end to the mat portion, preferably behind the electrical contact(s). The length of the tether may be variable to suit different users and different sizes of golf club.

The tether may be electrically conducting and may be in electrical contact with the electrically conducting section of the golf club sole portion. In this case, an open electrical circuit may be formed with the electrical conducting portion and one electrical contact as ends of that open circuit.

The circuit may be closed by the electrically conducting portion touching the contact. The circuit may also include the indicator means and a power source.

The indicator means may operate visually, aurally or both.

According to another aspect of the present invention a method of practising training a golf swing comprises swinging a golf club portion of a golf swing trainer and attempting to complete an electrical circuit in a mat portion of the trainer with an electrically conducting section of a head section of the golf club portion, the mat portion including at least one electrical contact which is electrically connected to indicator means, said indicator means indicating when the electrically conducting portion has completed the electrical circuit.

The invention extends to a golf club for a golf swing trainer having a sole portion, a section of which is electrically conducting and a section of which is electrically non-conducting.

The invention also extends to a golf club having a shaft section which is inclined in a forward direction when a sole portion thereof is generally horizontally aligned.

The forward inclination may be at an angle of between about 1° and 45°. The forward inclination may be between about 5° and 25°.

The invention extends to a golf swing training device, in which a golf club portion has a tether attached between the golf club portion and a mat portion of the trainer, the tether being arranged to limit the length of the back swing of a person using the trainer.

All of the above aspects may be combined with any of the features of the invention disclosed herein, in any combination.

Specific embodiments of the present invention will now be described, by way of example, with reference to the accompanying drawings, in which.

Figure 6A:
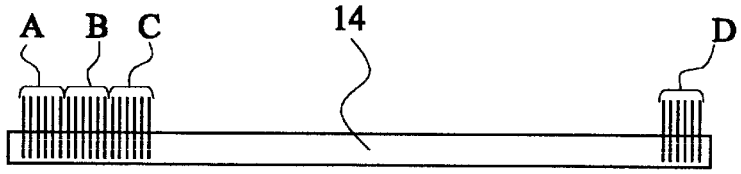
Figure 6B:
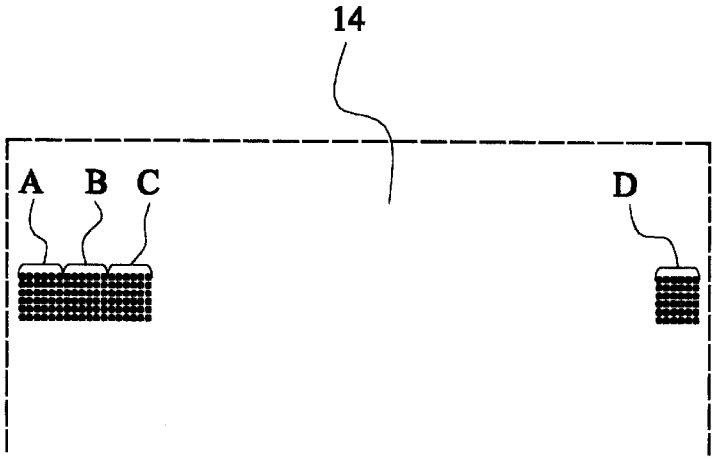
Figure 7:
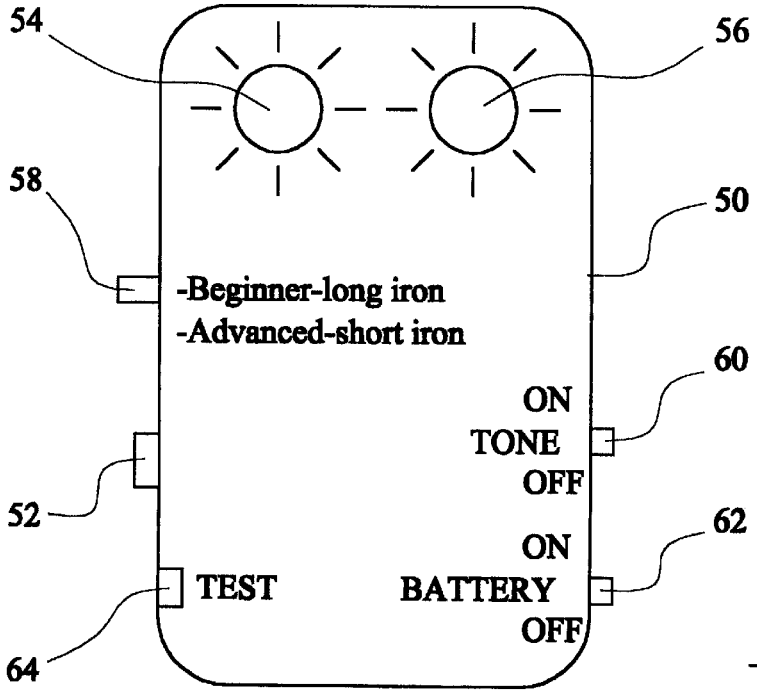

FIG. 6*a* is a schematic cross-sectional view of a further embodiment of electrical contact inserted in to a mat;

FIG. 6*b* is a schematic plan view of the arrangement shown in FIG. 6*a;* and FIG. 7 is a schematic view of a control unit for the golf swing trainer.

A golf swing trainer 10 comprises a golf club 12 and a mat 14. A head 13 of the golf club 12 has an electrically conducting leading edge 16 and an electrically non-conducting/insulating sole 18. When the golf club 12 is swung correctly, at the bottom of the player's swing the leading edge 16 makes an electrical contact between contacts 20*a* and 20*b* (see FIG. 2), which are embedded in the mat 14. The electrical contact between the leading edge 16 and the contacts 20*a* and 20*b* completes an electrical circuit and causes an alarm (not shown) to indicate by a sound or light for instance that correct contact has been made and a good swing has been performed.

The electrically conducting leading edge 16 extends along the base of a front face 22 of the golf club head 13, adjacent to a sole 18. The leading edge 16 may be made of metal, which also has the benefit of being a durable material, given that the leading edge 16 will strike both the ground, and perhaps a golf ball during use.

Behind the leading edge 16, the remainder of the sole 18 is made of an electrically non conducting or insulating material which extends across the whole of the sole 18 except for along the leading edge 16. This arrangement results in the sole 18 comprising a thin strip of electrically conducting material extending across the front of the sole, with the remainder being electrically insulating, thereby providing a discrete, limited area with which the club head 13 can complete the electrical circuit.

Figure 1:
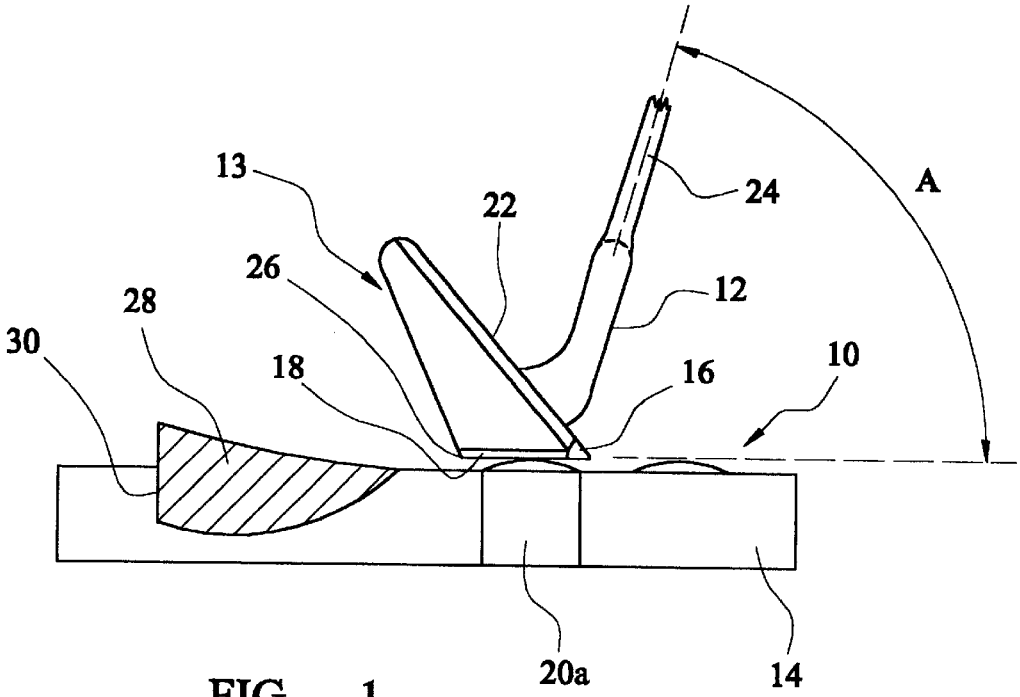
FIG. 1 is a schematic side view of a golf training device.
Figure 3:
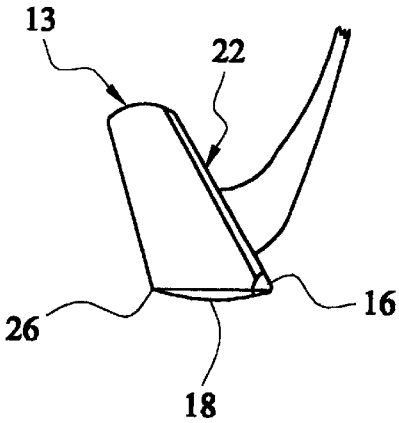
FIG. 3 shows a schematic side view of an alternative golf club to be used with the golf swing trainer shown in FIGS. 1 and 2.

As shown in FIGS. 1 and 3, the sole 18 of the golf club 12 can either be flat (FIG. 1), or may be curved (FIG. 3).

When the golf club is held so that a shaft portion 24 is vertical, a rear edge 26 is lower than the leading edge 16. In other words, when the sole 18 is approximately parallel with the mat 14 or the ground, an upper end of the shaft 24 is in front of the head 13 of the golf club. This results in an angle of less than 90° being formed between the sole 18 of the golf club head and the shaft 24. The angle is marked as A in FIG. 1. The effect that the angle A has on the functioning of the golf trainer 10 will be described below.

The mat 14 includes an insert 28 behind the contacts, which is made of an electrically insulating material, such as a rubber material. The insert is formed to act as an obstruction to the contacts being struck by a sweeping blow rather than by a downwards blow from the golf club 12, the latter being preferable. The insert has a wedge shape which tapers towards the contacts 20*a* and 20*b*. The insert 28 is an optional feature which can be removed from the mat 14, if desired. The insert 28 is located in a recess 30 in the mat 14.

Figure 2:
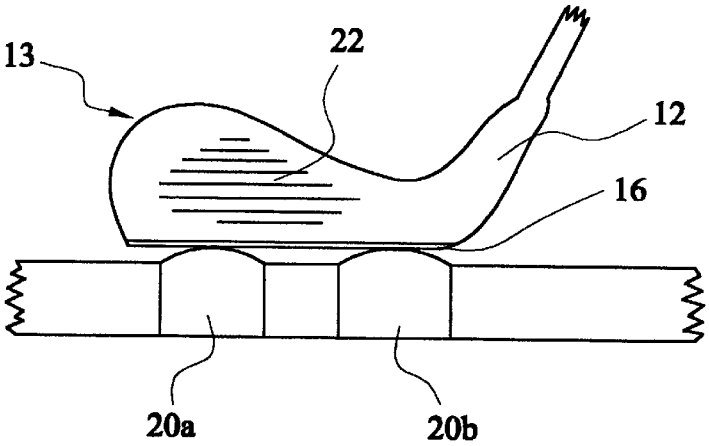
FIG. 2 shows a schematic front view of the golf swing trainer shown in FIG. 1.

The contacts 20*a* and 20*b* are partially recessed into the mat 14. A small amount of each contact 20*a*, 20*b* protrudes above the upper surface of the mat 14 to allow contact with the leading edge 16. A smooth profile of the projecting portion is presented so that a golf club striking the contacts can slide over the top thereof, rather than being caught by a projecting edge or the like. In FIGS. 1 and 2, the contacts are shown as being arranged side by side, at a separation which allows sufficient space between the two contacts 20*a*, 20*b* to prevent electrical contact there between, but at a sufficiently small distance that both contacts 20*a* and 20*b* can be electrically coupled by means of the electrically conducting leading edge 16 of the golf club 12.

The contacts are elongate in a left/right direction when viewing FIG. 1. The elongate shape allows for some inaccuracy in a player's swing. The length of contact can be chosen to suit a player's needs—a shorter contact can be used for a more proficient player, or a longer contact for a beginner.

The contacts 20*a*, 20*b* may be parallel to each other, aligned in the direction of swing, or a player's target. Alternatively, the contacts 20*a*, 20*b* could be in a "V"

formation, approaching each other in the direction of swing (i.e. to the right in FIG. 1).

Each of the contacts 20*a* and 20*b* is connected to an electrical supply (not shown), and to the alarm (not shown) which provides either visual or audio signals when the electrical circuit comprising the two contacts 20*a* and 20*b*, the electrical supply and the alarm is completed by the electrically conducting leading edge 16 of the golf club 12.

The contacts may be fitted into the mat by a push fit.

The electrical contacts may be threaded (if a circular version is used) to be received in correspondingly tapped holes in the mat 14. This would allow the golf trainer system to be retrofitted to an existing mat 14 by means of drilling and tapping holes to receive the contacts. Existing mats are already available for providing a suitably durable surface on which to practice swinging a golf club 12 and striking a golf ball.

Alternatively, the contacts 20*a* and 20*b* may be moulded into the mat 14 during production thereof.

The mat may be provided with a plurality of recesses in which to receive the contacts 20*a* and 20*b*, so that different arrangements of the contacts can be achieved. Unused recesses may have plugs therein for use when the contacts are not placed in those recesses.

The contacts 20*a* and 20*b* do not extend beneath the lower surface of the mat 14 to prevent undesirable electrical contact being made.

A contact area consisting of the contacts 20*a* and 20*b* and a portion of the surrounding mat can also be changed by re-moulding the mat in which the contacts 20*a* and 20*b* are located.

Figure 5:
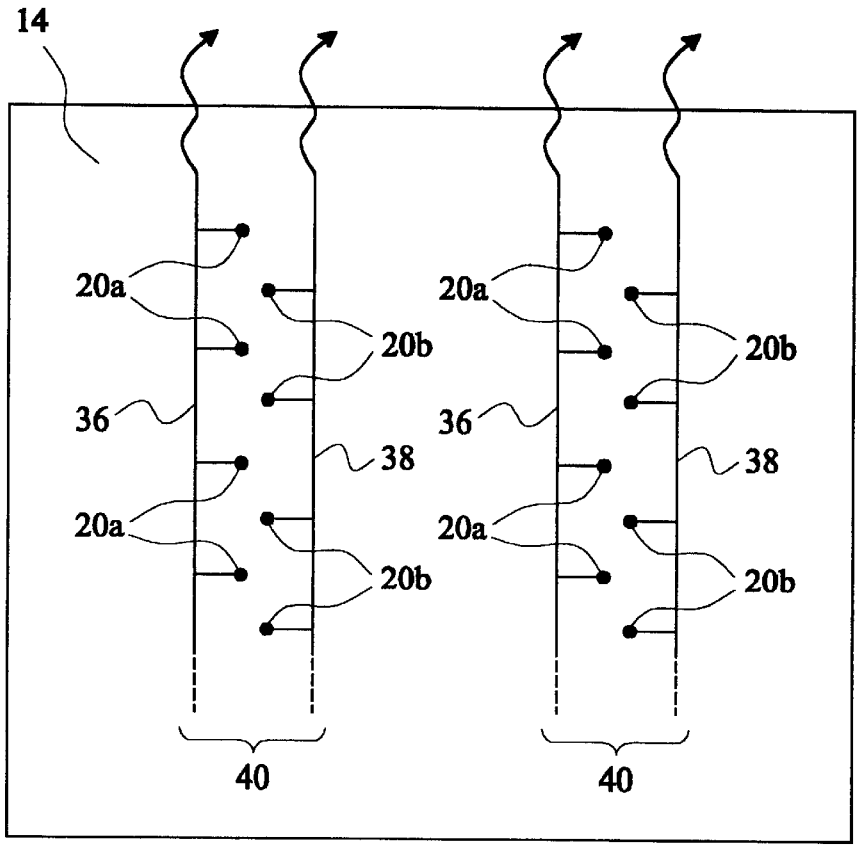
FIG. 5 is a schematic plan view of an embodiment in which strings of electrical contacts are placed in the mat.

The contacts 20*a* and 20*b* may be in the form of electrically conducting pins which extend vertically through the mat 14. FIG. 5 shows an alternative embodiment in which a plurality of electrical contacts 20*a* and a plurality of electrical contacts 20*b* are inserted into the mat 14. The electrical contacts 20*a* may be connected together in series as shown in FIG. 5. The electrical contacts 20*a* each extend from a connecting wire 36 which allows the contacts 20*a* to form a straight line with the contacts 20*b*, which contacts also extend from a connecting wire 38.

In the arrangement of contacts 20*a* and 20*b* shown in FIG. 5 each contact 20*a* is located between two contacts 20*b* (except the end contacts). Consequently, when using the golf swing trainer the golf club 12 may strike one of the contacts 20*a* and either of the adjacent contacts 20*b* to complete the circuit and thus indicate a good strike.

As shown in FIG. 5, a number of strips 40 of electrical contacts may be located parallel to each other across the mat. Each of the strips 40 may be separately connected to an alarm unit. When a particular contact is made in one of the strips 40, then its corresponding light or individual sound is emitted from the control unit (see FIG. 7). In this way, a user can identify whether it is the correct strip 40 of electrical contacts which has been struck. The strips 40 of electrical contacts 20*a* and 20*b* may be placed very close to each other (whilst still being insulated from one another) to allow for a large number of strips 40 to be placed together and allow for very accurate location of the striking point on the mat 14 which a user achieves. This will allow a user to determine whether he has struck the mat just before, just after or in exactly the right position. In order to do this, the user must make a note of the particular strip 40 on which the golf ball is initially placed.

The contacts 20*a* and 20*b* may be sewn into the upper surface of the mat 14.

The strips 40 of electrical contacts 20*a* and 20*b* need not necessarily be arranged parallel to the intended alignment of the leading edge of the golf club, as would normally be the case. Instead, they may be arranged in a pattern that will indicate an aspect of a golfer's contact between the golf club 12 and the mat 14. For instance, the angle of the strips 14 may be moved from a parallel position to the intended angle of the golf club head to an angle which indicates the actual angle that the leading edge of the golf club 12 makes with the ball, in relation to the intended line of flight of the ball.

The electronics in the indicated box may be arranged to allow an alarm to be triggered even if only one of the contacts 20*a* or 20*b* has been struck by a golf club 12. This may be achieved by measuring a change in the conductivity of the contact which may occur when the golf club 12 strikes a particular contact. Another change may be the capacitance, or a circuit may be made between the golf club head, contacts 20*a* or 20*b* via the golfer to earth.

The golf swing trainer may also include an option for selecting an advanced/beginner degree of difficulty of striking the correct area on the mat 14, which area may be marked on the mat 14 by branding or staining with ink, where the ball should be placed prior to striking. The difference between advanced and beginner options may be that a larger number of contacts will be accepted as a good strike, leading to a green light or a pleasant tone for instance, than would be the case with an advanced level of difficulty, in which fewer contacts can lead to the correct striking.

The contacts 20*a* and 20*b* shown in FIG. 5 arranged in strips 40 could each be wired separately to a control box, in which case the control box can indicate exactly which two contacts 20*a* and 20*b* have been connected by the golf club. This will assist in the user determining accurately exactly what problems may be present with their golfing technique.

FIGS. 6*a* and 6*b* show an alternative embodiment of arrangement of the electrical contacts in the mat. The electrical contact 20*a* may be replaced by a plurality of electrically conducting bristles shown by A in FIGS. 6*a* and 6*b*. Adjacent to this area of bristles A may be a non-conducting area of bristles B, adjacent to which is a further section of conducting bristles C which corresponds to the contact 20*b* in previous embodiments. The pattern of conducting bristles adjacent to non-conducting bristles, followed by a further section of conducting bristles may be repeated across the mat 14 up to the section of bristles D shown in FIGS. 6*a* and 6*b*. The size of the sections of conducting and non-conducting bristles A, B, C, can be chosen to reflect different levels of difficulty and can also be arranged on the surface of the mat 14 in any arrangement. In FIGS. 6*a* and 6*b* the leading edge of a golf club 12 is intended to extend across between the sections A and C to make the proper electrical contact.

The electrically conducting bristles may be inserted into a grass effect mat 14 as follows. A tubular sheath may be placed over a pointed metal insertion tool which tool and sheath combination is then inserted into the mat so that the tube is embedded and extends through the mat 14. The pointed tool is then withdrawn from the sheath leaving the hollow tubular sheath in the mat 14. An electrically conducting wire can then be inserted through the tube and connected to the control box described above. The action of inserting the metal piercing tool and leaving a tubular sheath in the matting can be repeated as many times as is necessary. To create an area of non-conducting matting, the original plastic grass effect matting can be left in position or additional plastic tubes can be inserted with no conducting wires placed after insertion. A template can be used to mark the positions through which the contacts (or the tool which places the contacts in the mat) can either be forced or perhaps drilled. The electrical conducting wires protruding through the tubular sheets protrude slightly above the end of the sheath to allow electrical contact to be made with the golf club.

An alternative way of installing the contacts would be to make a slit or cut out a section in the mat and place a brush like insert into the mat 14. The insert would resemble a long toothbrush head with brush like rows inserted in the mat with the electrically conducting wires separated from each other by electrically non-conducting tubes or brush sections. Every second group of conducting wires can be connected up to each other to form the two sets of contacts as shown by 20*a* and 20*b* in FIG. 5.

FIG. 7 shows a control unit 50 to which the wires from the contacts 20*a* and 20*b* are connected via a socket 52. The control unit 50 includes a green light 54 and a red light 56 to indicate successful and failed striking attempts respectively.

The control unit also includes a beginners/advanced switch 58 as described above. Furthermore, there is a tone on/off switch 60 which can be used to switch the tone function on or off. There is a power on/off switch 62 and a test button 64 as mentioned above.

The golf swing trainer has a test button, which allows the gap between the contacts 20*a* and 20*b* to be short-circuited to check that the alarm is functioning correctly.

The trainer also has two terminals for connection of the wires (not shown) which provide the electrical supply. The alarm, which may take the form of an indicator device may have both light or sound indication means. The golf swing trainer may switch to select either one of the two alarms, or both.

Figure 4:
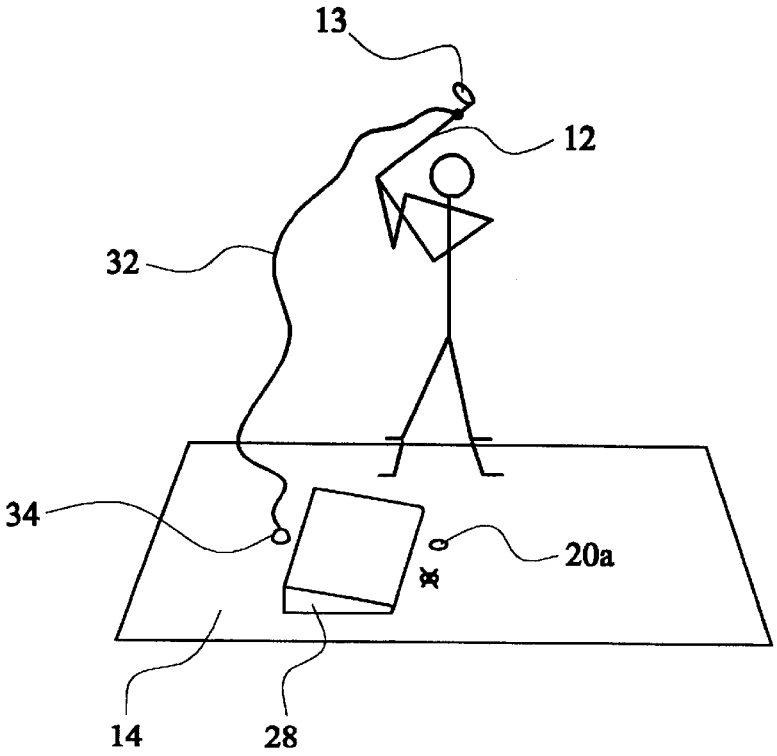
FIG. 4 is a schematic side view showing the golf swing trainer used with an optional tether between a golf club and a mat of the trainer.

A further feature of the golf swing trainer 10, shown in FIG. 4 is that a cord 32 may be attached at one end to the mat 14 and at its other end close to the head 13 of the golf club 12. The cord 32 may be used to control the length of back swing possible by a person using the golf swing trainer 10.

The cord may be adjustable in length to suit different sizes of user and different sizes of golf club.

The following embodiment of the golf swing trainer requires only one contact to be located in the mat 14. The cord 32 may be electrically conducting and its attachment to the mat 14 at point 34 (see FIG. 4) may link the electrically conducting cord 32 to the power supply (not shown). The cord 32 may take current to the golf club 12 and through to the electrically conducting leading edge 16 thereof. When the leading edge 16 then strikes the single contact 20*a*, the electrical circuit including the electrical power supply and the alarm is completed.

The system can also be used with two contacts 20*a* and 20*b*, as shown in FIGS. 1 and 2, with a cord 32 which is not electrically connected to the remainder of the golf swing trainer circuit.

In use, a person holds the golf club 12 in the normal way and commences the back swing by swinging the golf club behind their head. The length of the back swing is limited by the cord 32, which can be adjusted. The person then swings the club downwards with the intention of making a electrical contact between the contacts 20*a* and 20*b* with the leading edge 16 of a golf club. In order to do this, the player must bring the club in a downwards motion in order to avoid hitting the insert 28. Also, the person must swing the golf club through the correct angle of attack with the leading edge of the golf club being the lowermost part (or at least level with the remainder) of the sole 18.

If the above swing is followed, then electrical contact will be made and the alarm means will be activated. In order to achieve an electrical contact, the player should not swing the club in a sweeping motion from behind the contacts 20*a* and 20*b* (thereby undesirably commencing an upward motion of a club) and must not use too steep an approach angle.

The angle A made between the shaft of the club and the sole 18 of the club head 13 assists in the correct angle of attack to the contacts, because in order to keep the leading edge 16 either horizontal in relation to the remainder of the sole or below the remainder of the sole, the end of the golf club shaft 24 held by the person must be in front of the club head as it is swung towards the contact. This produces a desirable downwards attack angle on the contacts, if the leading edge 16 is to come into contact with the contacts 20*a*, 20*b*.

In the alternative embodiment shown in FIG. 4 in which only one electrical contact is used in the mat, with the circuit being completed between the electrically conducting cord 32 connected to the golf club 12, the user must use the same angle of attack and positioning of the golf club as described above to make the necessary electrical contact.

The provision of a golf club head 13 which has only a small portion of the sole 18 which is electrically conducting, the remainder thereof being non conducting, provides a golf swing trainer which requires a very accurate swing of the golf club to complete the electrical circuit and activate the visual or audio indication means.

The golf swing trainer device solves the problem of not being able to practice the learning of the skill enabling a person to strike a golf ball correctly and automatically, without thinking of the process consciously during the golf swing. The system can be used with or without a golf ball.

The golf swing trainer allows the reduction of the time required to learn the skill through constant repetition of the striking of the correct hitting area.

The golf swing trainer allows the training of the fine motor skills required to develop a swing in which a golf ball can be struck correctly.

The reader's attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extend to any novel one, or any novel combination, of the features disclosed in this specification (including any accompanying claims, abstract and drawings), or to any novel one, or any novel combination, of the steps of any method or process so disclosed.

What is claimed is:

1. A golf swing trainer comprises a golf club portion and a mat portion, the golf club portion comprising a shaft section and a head section, which head section has a section which is electrically conducting, the mat portion providing a surface on which to practise a golf swing and including at least one electrical contact, wherein indicator means of the trainer are operable to be activated when contact is made between the electrically conducting section of the head section and the or each electrical contact.

2. A golf swing trainer as claimed in claim 1, in which the electrically conducting section is a section of a sole portion of the head section.

3. A golf swing trainer as claimed in claim 2, in which the sole portion additionally includes an electrically non-conducting section.

4. A golf swing trainer as claimed in claim 3, in which the electrically non-conducting section is larger than the electrically conducting section.

5. A golf swing trainer as claimed in claim 1, in which the electrically conducting section is located on a front edge of a sole portion of the head section.

6. A golf swing trainer as claimed in claim 1, in which the electrically conducting section is located along a leading edge of the head section of the golf club portion, which leading edge is the foremost part of the head section.

7. A golf swing trainer as claimed in claim 1, in which the electrically non-conducting section is located to the rear of the electrically conducting section.

8. A golf swing trainer as claimed in claim 1, in which the shaft section of the golf club portion is inclined in a forward direction when the sole portion is generally parallel to an upper surface of the map portion.

9. A golf swing trainer as claimed in claim 1, in which a rear section of a sole portion of the head section is lower than a front section of the sole portion, when the shaft of the club portion is in a generally vertical orientation.

10. A golf swing trainer as claimed in claim 1, in which the or each electrical contact projects by a small amount above an upper surface of the mat, to allow contact to be made between the conducting section and the or each electrical contact.

11. A golf swing trainer as claimed in claim 1, in which at least one pair of electrical contacts is provided, in which the electrically conducting portion of the golf club is arranged to complete an electrical circuit by bridging said at least one pair of electrical contacts.

12. A golf swing trainer as claimed in claim 11, in which, where two electrical contacts are provided, the contacts may form two ends of an open circuit that includes the indicator means and a power supply.

13. A golf swing trainer as claimed in claim 12, in which the open circuit is closable by means of the electrically conducting portion of the golf club contacting both contacts, thereby causing the indicator means to be activated.

14. A golf swing trainer as claimed in claim 11, in which the electrical contacts comprise at least two lengths of a plurality of electrical contacts, the contacts in each length preferably being connected together in series.

15. A golf swing trainer as claimed in claim 1, in which each electrical contact is connected separately to a control means of the golf swing trainer.

16. A golf swing trainer as claimed in claim 1, which includes a tether portion connected between the golf club portion and the mat portion to limit the length of back swing of a person using the trainer.

17. A golf swing trainer as claimed in claim 16, in which the tether is electrically conducting and is in electrical contact with the electrically conducting section of the golf club sole portion.

18. A method of practising/training a golf swing comprises swinging a golf club portion of a golf swing trainer and attempting to complete an electrical circuit in a mat portion of the trainer with an electrically conducting section of a head section of the golf club portion, the mat portion including at least one electrical contact which is electrically connected to indicator means, said indicating means indicating when the electrically conducting portion has completed the electrical circuit.

* * * * *